US011904201B1

(12) United States Patent
Patrick et al.

(10) Patent No.: US 11,904,201 B1
(45) Date of Patent: Feb. 20, 2024

(54) TREADMILL FOR BACKWARD WALKING

(71) Applicants: Ben Patrick, Clearwater, FL (US); Greg Olson, Owatonna, MN (US); Zachary Olson, Owatonna, MN (US)

(72) Inventors: Ben Patrick, Clearwater, FL (US); Greg Olson, Owatonna, MN (US); Zachary Olson, Owatonna, MN (US)

( * ) Notice: Subject to any disclaimer, the term of this patent is extended or adjusted under 35 U.S.C. 154(b) by 0 days.

(21) Appl. No.: 18/189,882

(22) Filed: Mar. 24, 2023

(51) Int. Cl.
*A63B 22/02* (2006.01)

(52) U.S. Cl.
CPC ..... *A63B 22/02* (2013.01); *A63B 2022/0278* (2013.01)

(58) Field of Classification Search
CPC ..... A63B 22/02; A63B 2022/0278
See application file for complete search history.

(56) References Cited

U.S. PATENT DOCUMENTS

| | | | | |
|---|---|---|---|---|
| 5,447,479 | A * | 9/1995 | Gvoich | A63B 22/02 482/64 |
| 7,381,161 | B2 | 6/2008 | Ellis | |
| 7,575,537 | B2 | 8/2009 | Ellis | |
| 8,007,409 | B2 | 8/2011 | Ellis | |
| 8,172,729 | B2 | 5/2012 | Ellis | |
| 8,398,529 | B2 | 3/2013 | Ellis | |
| 8,454,479 | B2 | 6/2013 | Ellis | |
| 11,253,743 | B1 * | 2/2022 | Mosqueda | A63B 21/065 |
| 2016/0206922 | A1 * | 7/2016 | Dalebout | A63B 22/02 |
| 2016/0263429 | A1 * | 9/2016 | Wagner | A63B 22/18 |
| 2017/0326407 | A1 * | 11/2017 | Johnson | A63B 22/203 |
| 2022/0040528 | A1 * | 2/2022 | Manzke | A63B 69/0057 |

FOREIGN PATENT DOCUMENTS

| | | | |
|---|---|---|---|
| AU | 2005338658 | A1 | 12/2010 |
| AU | 2010306662 | A1 | 5/2012 |
| BR | PI0520724 | A2 | 5/2009 |
| CA | 2632086 | C | 6/2007 |
| CA | 2777716 | C | 4/2011 |
| CA | 2696163 | C | 3/2014 |
| CA | 2865214 | | 9/2014 |
| EP | 1954358 | A4 | 4/2009 |
| EP | 2488261 | A1 | 8/2012 |
| EP | 2164578 | A4 | 6/2013 |
| EP | 2709734 | A1 | 3/2014 |
| JP | 2009517173 | A | 4/2009 |
| WO | WO2007064318 | A1 | 6/2007 |
| WO | WO2008146083 | A2 | 12/2008 |
| WO | WO2009008877 | A1 | 1/2009 |
| WO | WO2009061674 | A1 | 5/2009 |
| WO | WO2011047247 | A1 | 4/2011 |
| WO | WO2012161681 | A1 | 11/2012 |

* cited by examiner

*Primary Examiner* — Sundhara M Ganesan
*Assistant Examiner* — Jacqueline N L Loberiza
(74) *Attorney, Agent, or Firm* — Brad Bertoglio; Intelink Law Group, P.C.

(57) ABSTRACT

A treadmill for backward walking is disclosed. The treadmill may include a static frame and dynamic platform pivotally mounted to the static frame. A C-shaped support handle includes side portions that may be grasped or otherwise used by a user to stabilize their position, and a cross member against which the user may lean, e.g. with the user's hips or back. A user may press against a treadmill belt with the user's feet, against resistance from a brake, to move the treadmill belt away from the user's body.

18 Claims, 12 Drawing Sheets

TREADMILL FOR BACKWARD WALKING

BACKGROUND

1. Field

The present disclosure relates in general to exercise equipment, and more specifically, to a treadmill intended for use while walking backwards.

2. Related Art

Backward walking against resistance is becoming an increasingly popular form of exercise, with many individuals experiencing benefits to strength and health of the legs and knees. Typically, such exercises are performed using a sled that is weighted or braked. A user may pull such a sled while walking backwards over a distance using, e.g., a rope secured around the user's waist.

However, dragging a sled while walking backwards typically requires a substantial amount of open space across which a user may walk. Many indoor facilities may lack sufficient open space. Many locations may have outdoor conditions (e.g., accumulation of snow or ice, rain, excessive heat) which limit an individual's ability to use such an exercise sled outdoors. Many locations may also have uneven or inconsistent ground surfaces, resulting in inconsistency or uncontrolled variation of resistance as well as risk of tripping. Therefore, many individuals seeking the health benefits of backward walking against resistance must seek other solutions.

One such alternative exercise is backward walking on a treadmill. However, most treadmills are designed for a user to walk or run in a forward direction, with support structures and other ergonomics designed for forward-facing use. Further, most common treadmills are powered, not designed to provide resistance against movement. Some individuals have used such treadmills in an unpowered state to provide resistance against movement while backward walking. However, the degree of resistance control can be very limited and such use may also be damaging to the treadmill's motors and other components. Traditional treadmills may provide equipment geometry that is not ergonomic for backward use or lacks important safety features. To the extent they are not intended for unpowered or backward use, traditional treadmills may also provide inconsistent resistance levels and/or undesirable resistance dynamics.

Traditional treadmills can also be relatively large, heavy, costly items requiring sophisticated maintenance. To the extent a treadmill is dedicated for backward use, it may be increasingly important to provide a design that is compact, low-cost and easy to maintain, while potentially simulating or even improving upon resistance dynamics associated with pulling of a weighted sled.

SUMMARY

Disclosed is a treadmill for backward walking against resistance, along with associated modes of use. The treadmill may be formed from a static frame and dynamic platform. The static frame may include a pair of upright bars supporting a support handle. The dynamic platform may include a frame, a deck supported within the frame, and first and second rollers each rotatably mounted to the frame at opposite ends. A treadmill belt encircles the deck and rollers. A brake acts on at least one of the rollers (or flywheels attached to the rollers) to resist movement of the treadmill belt over the deck. The support handle may be adjustable in height, and/or angle relative to the deck to, e.g., aid in backward positioning.

The platform is attached to the static frame by mounts. Preferably, the mounts are movable, such as pivots, wherein the platform may be rotated between a deployed configuration, in which the deck is generally aligned relative to a ground surface on which the treadmill is supported (whether flat/coplanar with the ground, or angled relative to the ground); and a stowed position, in which the platform pivots up between side portions of the support handle.

Also disclosed are methods for a person to engage in backward walking on the treadmill, for physical training. In one such embodiment, a person may grasp left and right portions of the support handle, while resting a backside of the person's body (e.g., hips) against a support handle cross portion joining the left and right portions. The person may press forward against the treadmill belt using the person's feet, while using the support handle cross portion against the person's hips as an anchor point, to move the treadmill belt away from the person against resistance from the brake.

In accordance with a related method of use, a person may rest their left and right forearms against left and right portions, respectively, of the support handle. The person's back may rest against the support handle cross portion, spanning the left and right portions of the support handle. The person may press forward against the treadmill belt using the person's feet, while using the support handle cross portion against the user's back as an anchor point, to move the treadmill belt away from the person against resistance from the brake. The vertical position of the user or the height of the support handle may be adjusted relative to the deck to vary a range of motion over which the person's knees move while pressing forward against the treadmill belt.

Other devices, apparatuses, systems, methods, features, and advantages of the invention will be or will become apparent to one with skill in the art upon examination of the following figures and detailed description. It is intended that all such additional devices, apparatuses, systems, methods, features, and advantages be included within this description, be within the scope of the invention, and be protected by the accompanying claims.

BRIEF DESCRIPTION OF THE FIGURES

The invention may be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1:
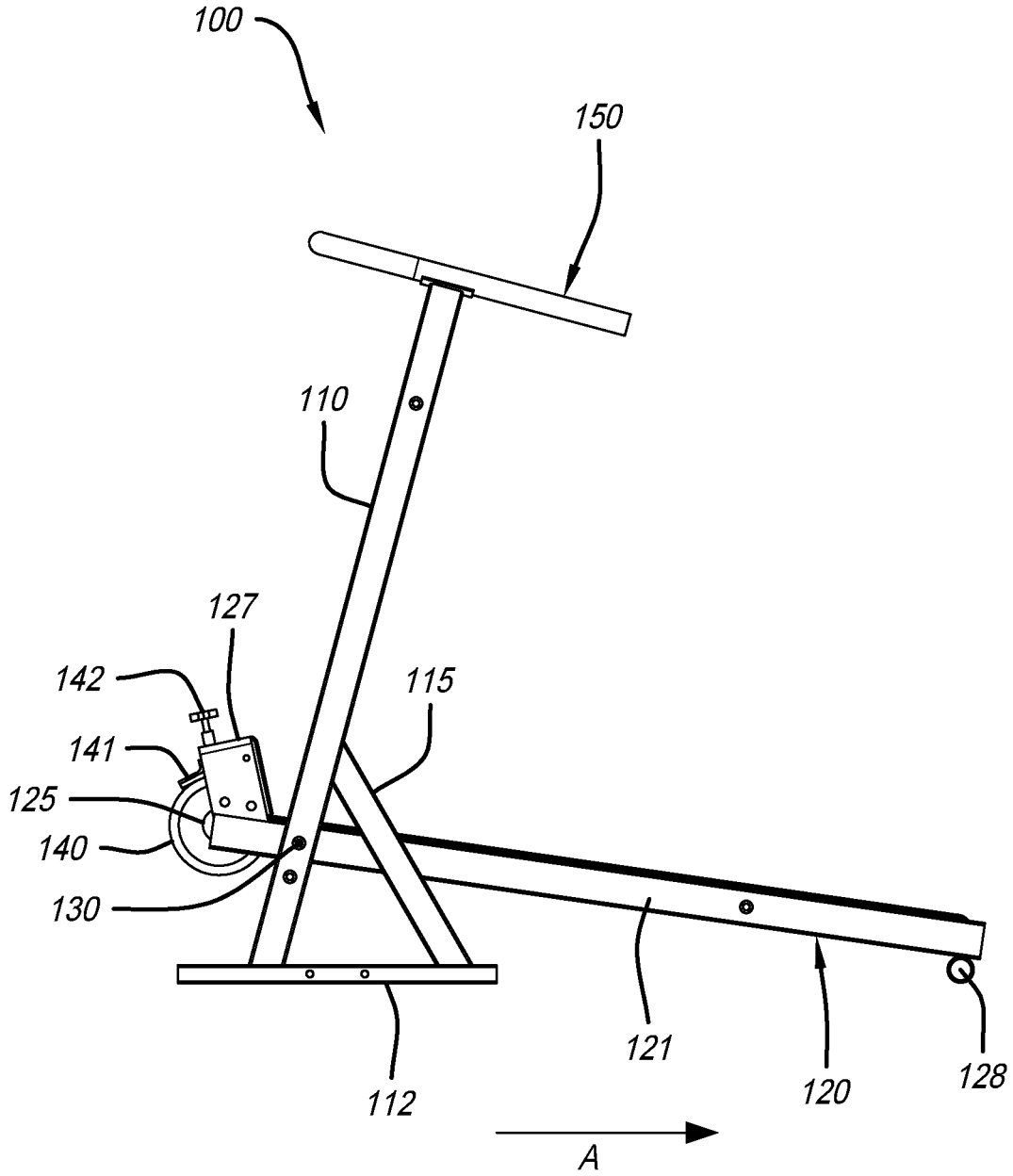
FIG. 1 is a side-view of a treadmill for backward walking, in accordance with an exemplary embodiment.
Figure 2:
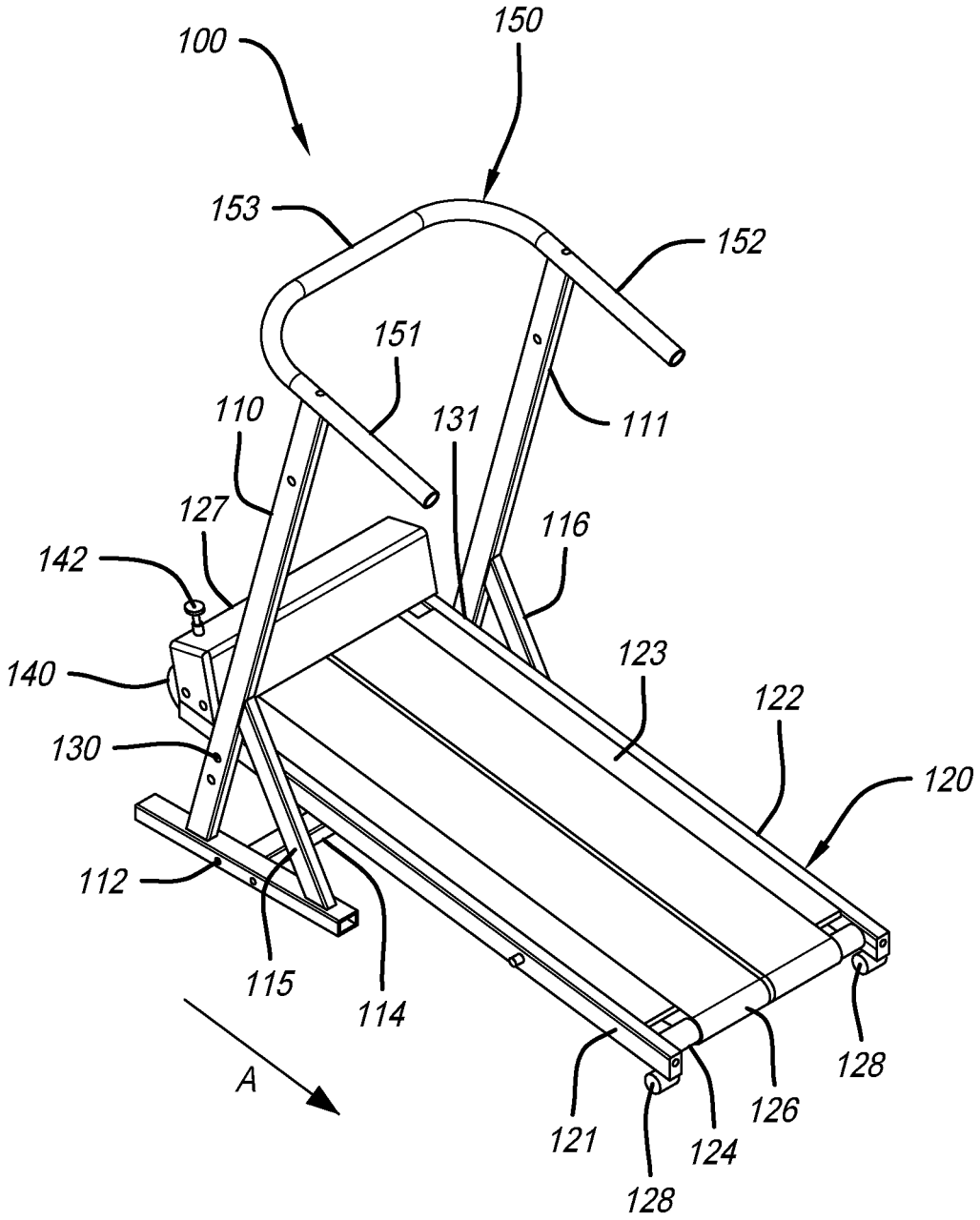
FIG. 2 is a perspective view of the treadmill for backward walking.
Figure 3:
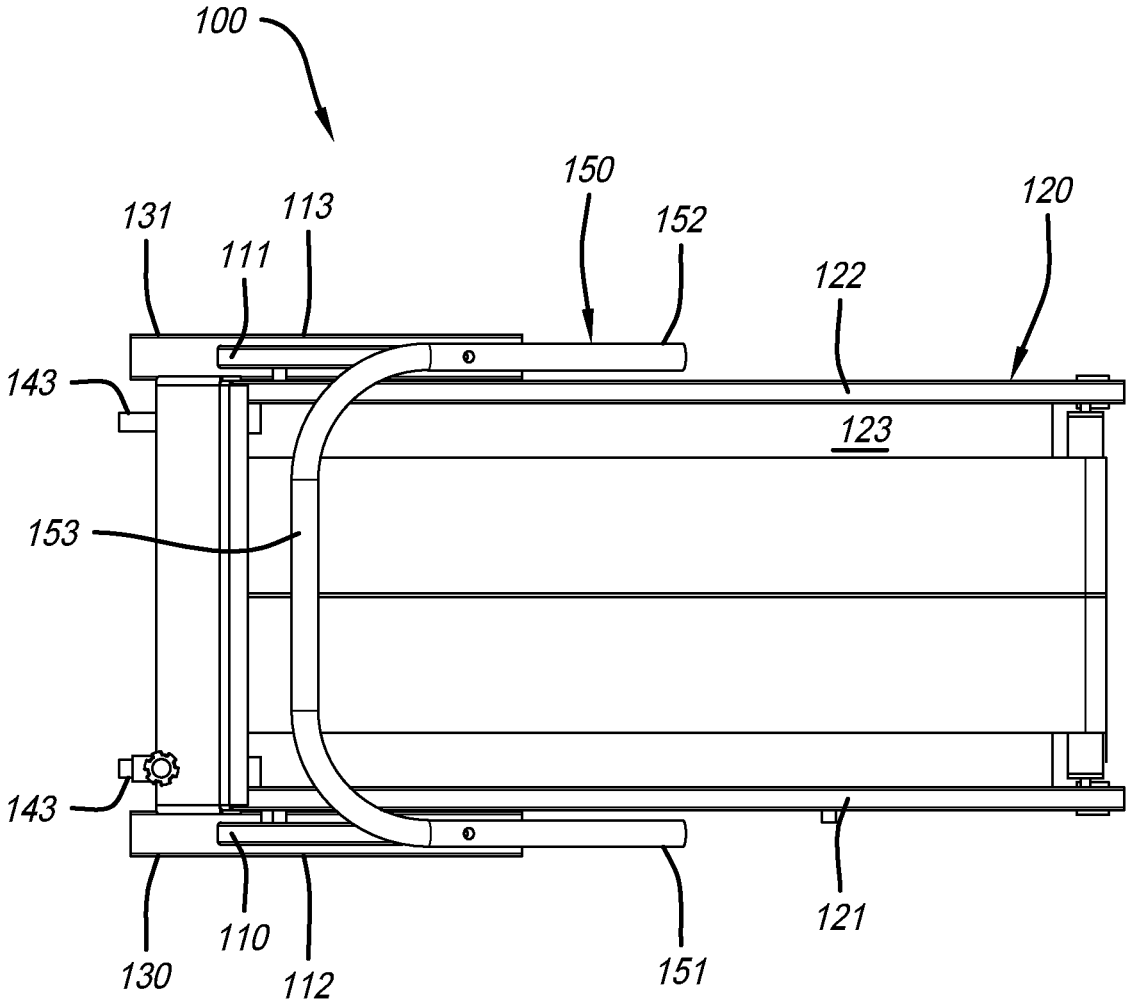
FIG. 3 is top view of the treadmill for backward walking.

A treadmill designed for backward walking is provided for physical training. FIG. 1 is a side view of a treadmill 100 for backward walking, in accordance with one exemplary embodiment. FIG. 2 illustrates treadmill 100 from a perspective view. FIG. 3 illustrates treadmill 100 from a top view. In each of FIGS. 1-3, treadmill 100 is placed in a deployed configuration for use in physical training. The structure and operation of treadmill 100, as illustrated in FIGS. 1-3, is further described as follows. As described herein, "left" and "right" are used from the perspective of a user facing in direction A, i.e., walking "backward" on treadmill 100.

Treadmill 100 is a foldable embodiment, formed from a static frame and dynamic platform. The static frame includes a pair of upright bars (specifically, right upright 110 and left upright 111), right base portion 112, left base portion 113, base cross member 114, support member 115, support member 116 and support handle 150. Right upright 110 is a rigid beam, fixedly mounted to, and extending upwards from, right base portion 112. Left upright 111 is a rigid beam, fixedly mounted to, and extending upwards from, left base portion 113. Base cross member 114 spans right base portion 112 and left base portion 113. Right base portion 112, left base portion 113 and base cross member 114 rest against a ground surface on which treadmill 100 is supported. Support member 115 spans a middle portion of right upright 110 and right base portion 112, providing additional rigidity and support. Similarly, support member 116 spans a middle portion of left upright 111 and left base portion 113. As such, right upright 110, left upright 111, right base portion 112, left base portion 113, base cross member 114, support member 115 and support member 116 form a rigid framework for treadmill 100 that is supported by a ground surface on which treadmill 100 rests.

Platform 120 provides a generally flat structure on which an individual using treadmill 100 may be supported during use. Platform 120 includes a frame formed from right side beam 121 laterally spaced from left side beam 122, defining a first or rear end proximate roller 125 and a second or front end proximate roller 124. Flat deck 123 spans right side beam 121 and left side beam 122, and provides a solid surface on which a user's weight is supported during use. Front roller 124 is rotatably mounted to, and spans, right side beam 121 and left side beam 122 at a first, front end thereof. Similarly, rear roller 125 is rotatably mounted to, and spans, right side beam 121 and left side beam 122 at a second, rear end thereof. Treadmill belt 126 wraps around front roller 124 and rear roller 125, further encircling and supported by flat deck 123.

Platform 120 is mounted to right upright 110 and left upright 111 via dynamic mounts, specifically, pivot 130 and pivot 131. Preferably, pivot 130 and pivot 131 are positioned longitudinally along right side beam 121 and left side beam 122, respectively, at a position between rear roller 125 and treadmill belt 126, closer to rear roller 125. Preferably, pivot 130 and pivot 131 are positioned along right upright 110 and left upright 111, respectively, at a level elevated above where right upright 110 connects to right base portion 112 and where left upright 111 connects to left base portion 113. Front feet 128 are attached to right side beam 121 and left side beam 122 at a front end of platform 120, below front roller 124, and rest upon a ground surface to support the front end of platform 120 when treadmill 100 is configured for use.

Preferably, when in use, platform 120 is angled downwards from a rear end proximate rear roller 125, towards a front end proximate front roller 124, i.e., an elevation level of pivot 130 and pivot 131 above the ground support surface is greater than the elevation of an end of platform 120 proximate front roller 124. Such an arrangement may provide an optimal configuration for use in a backward walking motion against resistance, as described further below. For example, a downward-sloping deck may provide desirable working angles for joints and help a user in overcoming static friction forces when starting movement of treadmill belt 126. In some embodiments, flat deck 123 will be angled downwards relative to level by an angle of 8 degrees. In other embodiments, the angle of flat deck 123 relative to level will be in the range of 7-9 degrees, within a range of 6-10 degrees, less than 15 degrees, or less than 30 degrees. However, it is contemplated and understood that in other embodiments, different angles may be utilized, potentially even including upward-sloping angles.

In the embodiment of FIGS. 1-3, the angle of platform 120 relative to a ground surface on which treadmill 100 rests is fixed when in use. While platform 120 and flat deck 123 may be at times described herein as "flat", it is contemplated and understood that in various embodiments and in various configurations, platform 120 and flat deck 123 may be configured to occupy a plane that is angled relative to a ground surface on which treadmill 100 is supported. Nonetheless, when in a deployed configuration for use by an individual in fitness training, the angle formed by flat deck 123 relative to a ground surface on which treadmill 100 is supported will typically be less than 45 degrees, and more typically less than 30 degrees.

By using a static upright arrangement (e.g., right upright 110, left upright 111, right base portion 112, left base portion 113, base cross member 114), and a fixed pivot point connected to a dynamic platform 120 (whether parallel to or slightly angled relative to a ground surface), a highly stable structure is provided in a matter that facilitates use, provides high reliability and relatively low cost. However, it is contemplated and understood that in other embodiments, it may be desirable to provide an adjustable angle for platform 120, thereby enabling users to work various muscles and joints from differing angles. The angle of platform 120 may be adjusted by, for example, providing front feet 128 having adjustable heights, providing feet on right base portion 112 and left base portion 113 having adjustable heights, or implementing pivot 130 and pivot 131 using a pivot mechanism having a position that can be varied along right upright 110 and left upright 111, respectively.

Support handle 150 spans right upright 110 and left upright 111. Support handle 150 is substantially C-shaped, having an open side facing forward (i.e. in direction A of FIG. 1). A right portion 151 of support handle 150 extends forward of right upright 110, while a left portion 152 of support handle 150 extends forward of left upright 111. A cross portion 153 of support handle 150 interconnects right portion 151 and left portion 152, extending rearward from right upright 110 and left upright 111, preferably spanning the width of platform 120 at a front-rear position roughly equal to, or slightly forward of, that of rear roller 125. Preferably, cross portion 153 is positioned at a height above platform 120 and flat deck 123 that is equal or near to the height of a user's hips. During use, an individual using treadmill 100 may be positioned within support handle 150, such that a user may readily grasp right portion 151 and left portion 152 for support and stability. Optionally a user can lean back against cross portion 153 for stability and leverage when pushing against treadmill belt 126.

In some embodiments, support handle 150 may be adjustable in its position relative to flat deck 123 and treadmill belt 126. For example, right upright 110 and left upright 111 may be formed from telescoping beams, such that their length (and therefore the height or elevation of support handle 150 over flat deck 123) is variable and adjustable by the user, to accommodate different user heights or modes of use.

Figure 10:
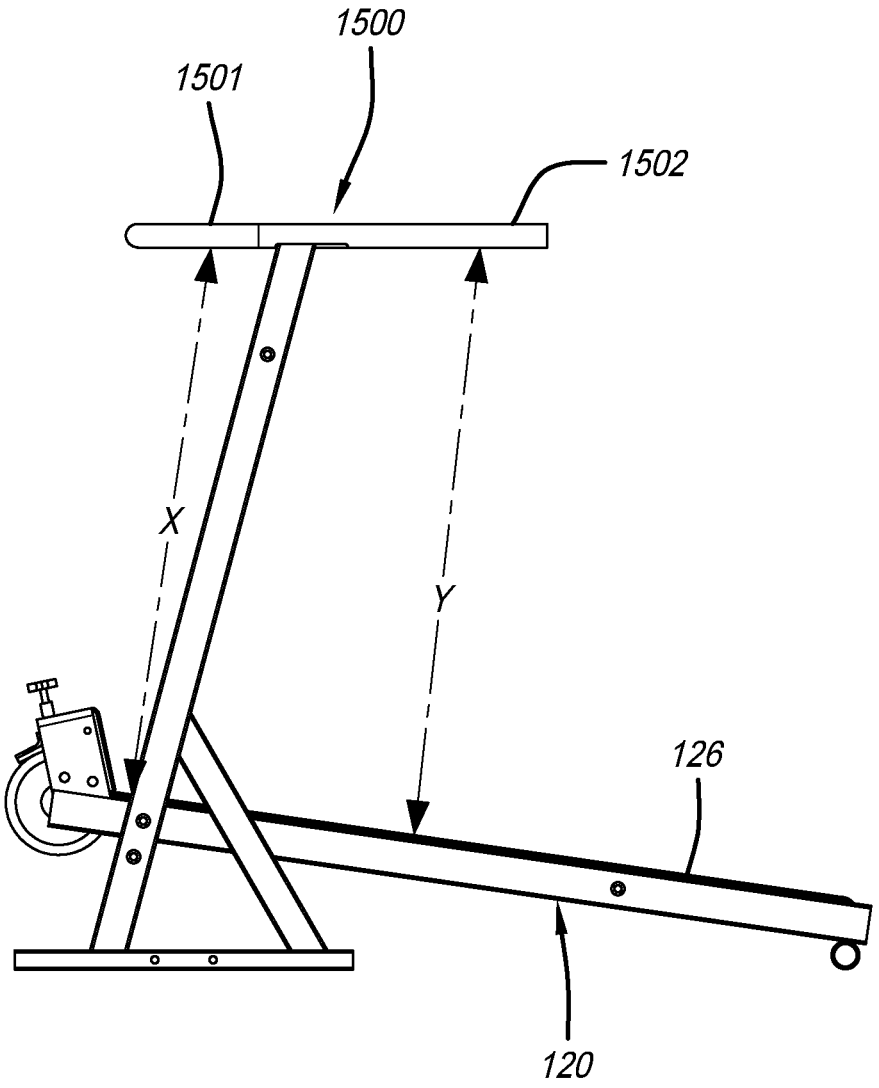
FIG. 10 is a side view of a treadmill embodiment having an angled support handle with varying height relative to the deck.

In other embodiments, alternative techniques for providing variable support handle height may be utilized. FIG. 10 illustrates such an embodiment. Support handle 1500 occupies a plane that is angled more upwards, from the perspective of a user, relative to a plane in which deck 123 resides. In some embodiments, support handle 1500 may be parallel to a ground surface on which the treadmill rests, whereas the deck 123 slopes downwards. As such, the distance between deck 123 and support handle 1500 varies along the length of support handle 1500. Users may grasp differing portions of support handle 1500 to experience a different height relative to the deck 123. For example, a user may shift position rearward within C-shaped support handle 1500 and grasp proximate position 1501 in order to experience a handle elevation of X. The user may shift position forward within C-shaped support handle 1500 and grasp position 1502 in order to experience a handle elevation of Y. Such an embodiment may provide variability in height of user hand positioning, without introducing additional mechanical complexity, additional cost or sacrifice of rigidity that may result from other embodiments such as ones having variable length uprights 110 and 111. Support handle 1500 occupies a plane that angles forward and upward relative to a plane in which the deck lies; however, it is contemplated and understood that in other embodiments, the plane of support handle 1500 can angle forward and downward, such that forward portions of support handle 1500 are lower relative to the deck and rearward portions of support handle 1500 are higher. Moreover, while support handle 1500 or support handle 150 may sometimes be described herein as occupying a plane, such description is intended to refer to a plane along which the support handle generally extends, such as an average—but should not be deemed to require or suggest that the support handle must be strictly flat. Indeed, it is contemplated and understood that in some embodiments, the support handle may occupy a curved path as it extends forward and rearward.

While support handle 150 is illustrated in the embodiment of treadmill 100 as having a particular shape, being substantially C-shaped, and rigidly mounted to right upright 110 and left upright 111, it is contemplated and understood that in other embodiments, alternative support handle structures may be utilized. For example, a support handle could be formed from multiple rigid elements, such as a first element secured to right upright 110 and a second element secured to left upright 111, without a rigid or integral cross member (in which case, a support strap such as that illustrated in FIG. 8 could be employed to provide resistance against which a user can lean). Additionally or alternatively, a support handle may be movably mounted to treadmill 100. For example, dampers or shock absorbers could be provided to enable controlled movement of the support handle relative to the remainder of the static frame. One or more components of the support handle may be hinged or pivotally mounted to the static frame to permit, e.g., adjustment of handle position or movement between differing configurations (such as stowed and deployed configurations). These and other variations of support handle 150 may be implemented within the scope of some embodiments contemplated herein.

Figure 7:
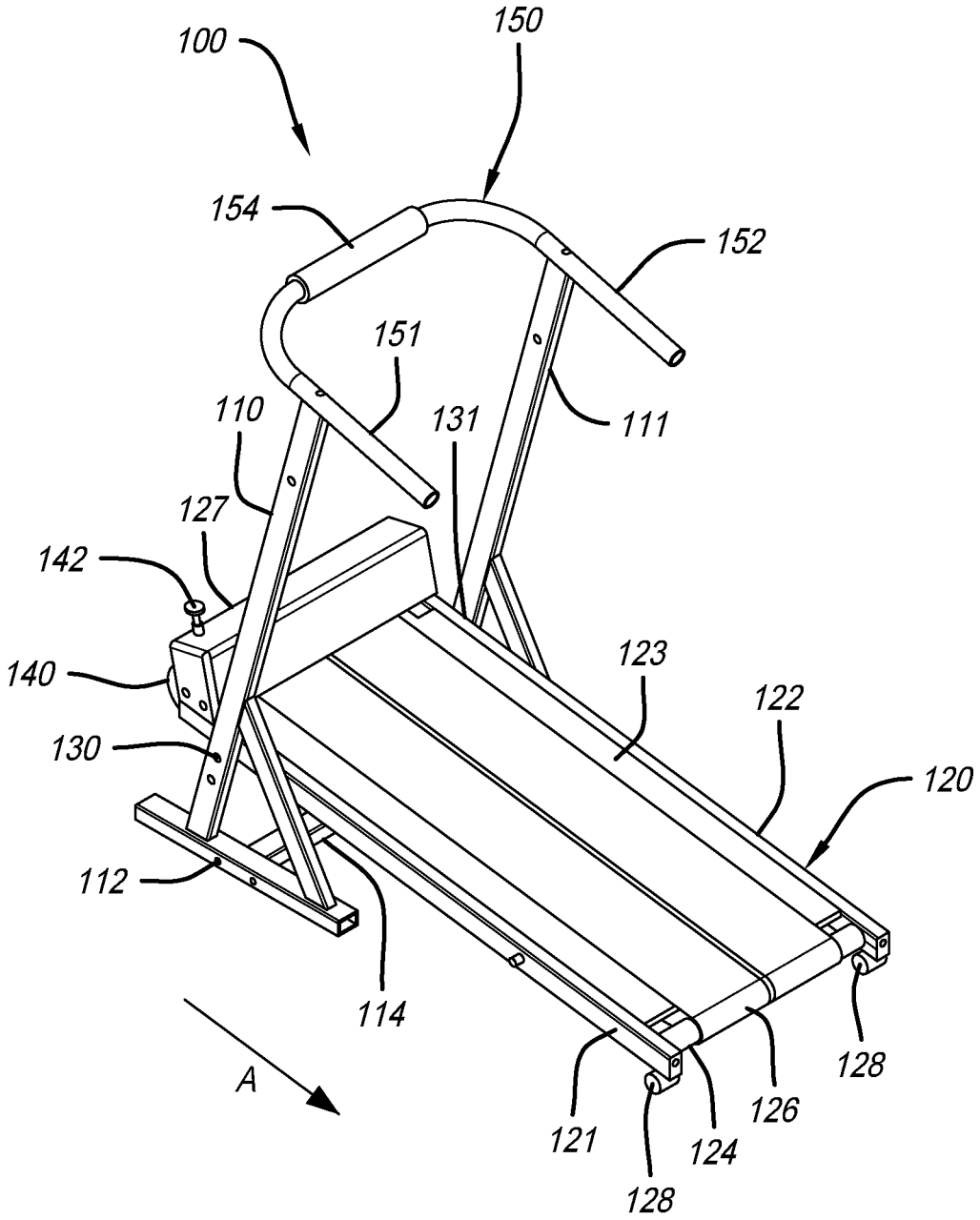
FIG. 7 is a perspective view of an embodiment having a cross-member pad.

In some embodiments, it may be desirable to provide a padded, cushioned or otherwise accommodating surface on support handle cross portion 153, so that a user may comfortably lean against cross portion 153 during use of treadmill 100. FIG. 7 illustrates such an embodiment of treadmill 100, as illustrated in FIG. 2, with a cross member pad. A pad 154 is mounted on cross portion 153 of support handle 150. Pad 154 may be a cylindrical pad having a hollow center through which a rigid cross portion 153 extends, analogous to the sort commonly used as a barbell shoulder pad. Pad 154 can thereby provide a comfortable surface against which a user may push as an anchor point for applying force to treadmill belt 126. Further, pad 154 can rotate around cross portion 153 when the user moves their body upward or downward relative to cross portion 153, thereby facilitating adjustment of the user's body to achieve varying working angles or body positioning, as described further hereinbelow. In various embodiments, pad 154 may be removable, or integrated within cross portion 153. Pad 154 may surround cross portion 153, or be positioned only on a side towards the user. These and other types and configurations of pads may be utilized in connection with the present invention.

Figure 8:
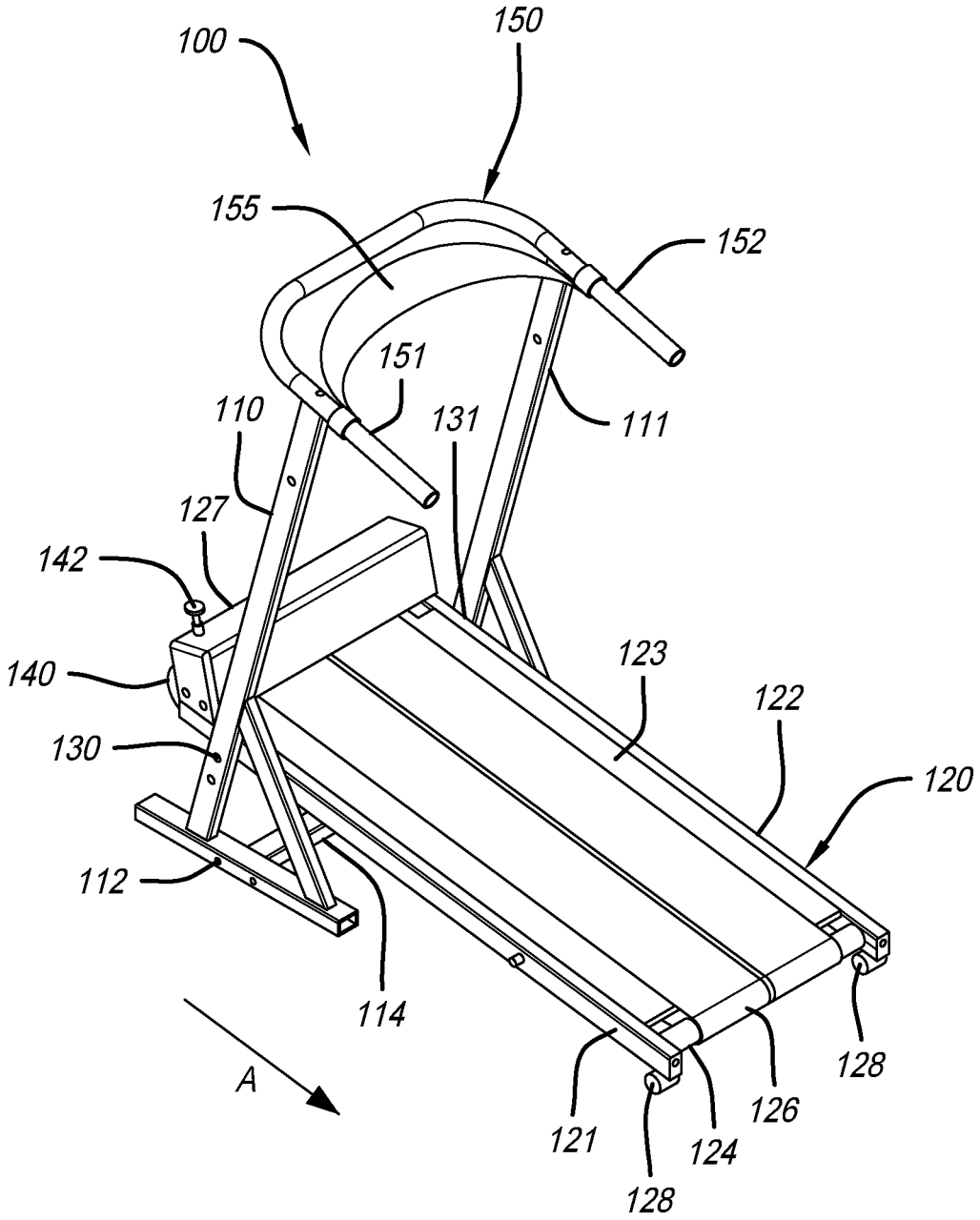
FIG. 8 is a perspective view of an embodiment having a support strap.

Other mechanisms may also be provided to help support a user comfortably in desired positions during use of treadmill 100. In the embodiment of FIG. 8, treadmill 100 is depicted having a support strap 155 attached to and extending between right portion 151 and left portion 152 of support handle 150. During use, a user may rest their body (e.g., their back, the back of the user's hips, or hamstrings) against support strap 155. A user may lean back against the strap, or sit on the strap to support some of the user's body weight, enabling users to use the treadmill with lower levels of exertion or strength required. Support strap 155 may be inelastic (e.g., for more precise support and positioning of the user's body during use), or have varying levels of elasticity (e.g., to provide greater comfort, enable the user to vary body positioning without moving support strap 155, and/or to force users to utilize stabilizing muscles to maintain body position during use). In some embodiments, support strap 155 will be formed from rubber to provide elastic support during use.

Figure 6:
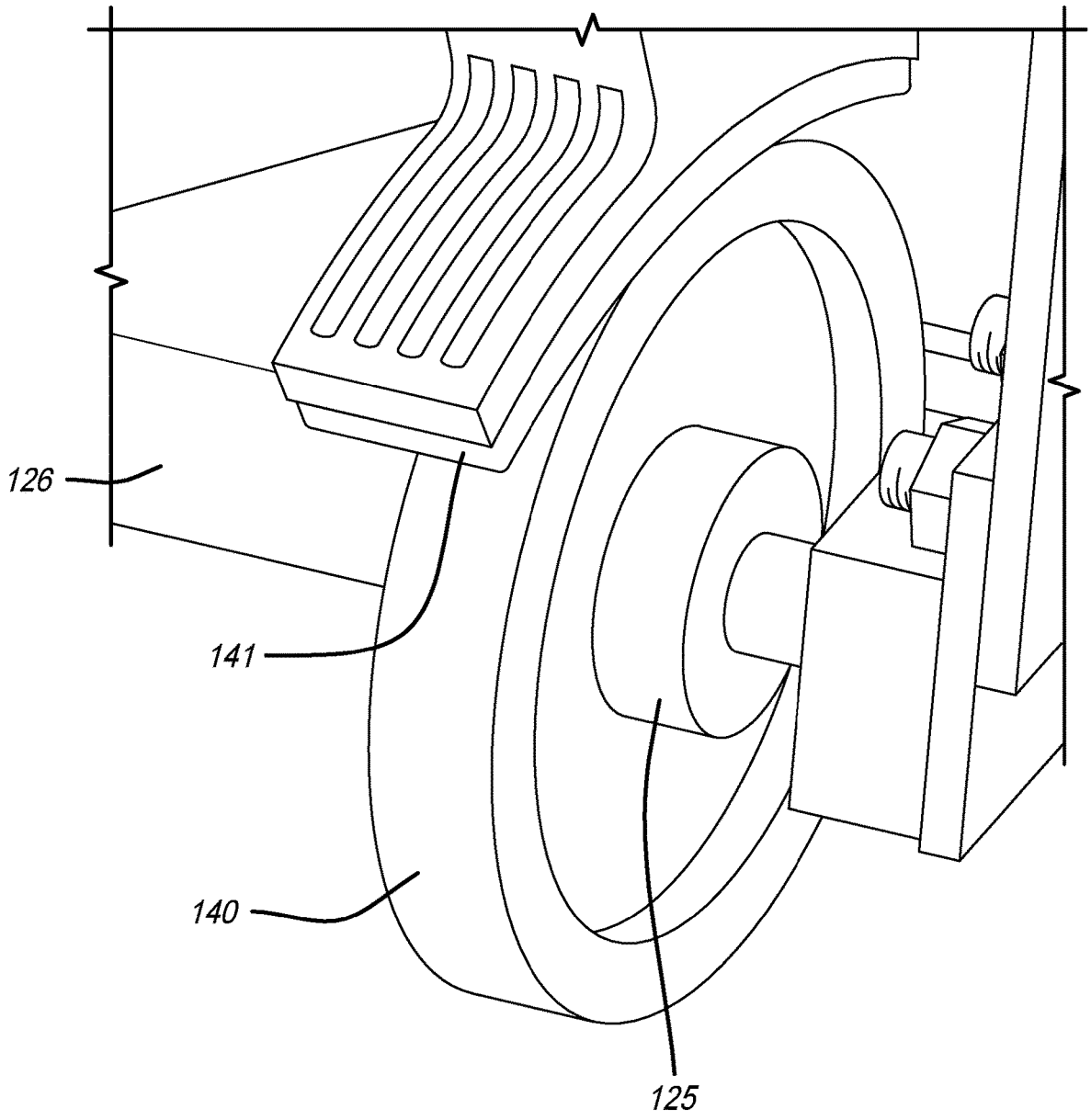
FIG. 6 is a partial cutaway view of a portion of a treadmill braking mechanism.

Treadmill 100 provides for user-variable resistance to movement of treadmill belt 126. FIG. 6 provides a partial cutaway view of a resistance mechanism implemented with rear roller 125. In particular, treadmill belt 126 wraps around a central portion of rear roller 125. Flywheel 140 is secured and mounted to (and rotates with) rear roller 125, to a side of treadmill belt 126. Protective cover 127 spans right side beam 121 and left side beam 122 and overlies rear roller 125 and flywheel 140. Friction brake 141 is mounted on protective cover 127 and may be contact flywheel 140 with variable force via rotation of adjustment dial 142. Accordingly, friction brake 141 may be adjusted by a user to control a level of resistance to rotation of flywheel 140, and thus rotation of rear roller 125 and movement of treadmill belt 126. The size of the braking mechanism (e.g., width and diameter of flywheel 140 and the size of friction brake 141) may be specified based, at least in part, upon a desired capacity for braking force, with greater brake surface area typically providing greater ranges of static and dynamic friction.

In addition to providing a mechanism for application of friction-based braking, flywheel 140 also may be utilized to develop inertial momentum for rotation of rear roller 125, front roller 124 and treadmill belt 126, thereby providing for smoother and more satisfactory movement of treadmill belt 126—particularly under the application heavy braking power, when an unweighted treadmill belt 126 mechanism may be subject to more abrupt stopping and starting during use. In some embodiments, such flywheel mass may be specified to simulate the user feel of the inertia of a weighted sled during backwards pulling. In such embodiments, it may be desirable to provide a flywheel 140 constructed from relatively heavy material, such as solid steel or iron. Additional flywheels may also be provided, in order to increase and/or balance the rotational mass. For example, in the embodiment of FIGS. 1-3, flywheel 143 is also provided, mounted on rear roller 125 in a laterally opposite end from flywheel 140 for balance. Yet in other embodiments, it may be desirable to minimize rotational mass, e.g., to alleviate potential safety concerns with an uncontrolled movement of the treadmill belt in the event a user slips, falls or seeks to quickly stop movement.

The combination of flywheel 140, friction brake 141 and adjustment dial 142 provides a mechanism for resisting rotation of front roller 124 and rear roller 125 (and thus movement of treadmill belt 126) that is effective, variable, reliable, easily-serviced, and relatively low cost. In the illustrated embodiment, friction brake 141 includes a felt pad. Adjustment dial 142 can be screwed in or out to vary force with which the felt pad is forced against flywheel 140. Such a braking mechanism has been found to effectively replicate the resistance characteristics of pulling a conventional weighted sled on e.g., turf, grass or a carpeted surface, providing an initial static friction component that must be overcome to initiate movement, followed by a dynamic friction component which must be overcome by the user to maintain movement of the treadmill.

However, it is contemplated that in other embodiments, alternative or supplemental mechanisms for providing such resistance may be implemented. For example, multiple flywheels (e.g., flywheel 140 and flywheel 143) could be independently braked; electromagnetic braking mechanisms could be used; braking mechanisms could be applied to front roller 124; braking mechanisms could be applied to both front roller 124 and rear roller 125; front roller 124 and/or rear roller 125 could be formed from internally-braked axles; or the like.

In the embodiment of FIGS. 1 and 2, protective cover 127 is illustrated as spanning the full width of platform 120. Conventionally, such protective covers for treadmills span the width of a treadmill belt, in order to e.g., minimize risk of inadvertent contact with the treadmill belt by people and things proximate the treadmill during use. This issue can be particularly important with a conventional powered treadmill designed for use potentially at running speeds, wherein something contacting the belt during use may be inadvertently swept under the treadmill by a powered electrical motor driving the belt at high speed and with great torque. However, such full width covers result in a portion of the belt surface underneath the covers being unavailable for use by a user of the treadmill. As such, the required length of the treadmill for a given length of usable surface is increased, and space efficiency is decreased.

Figure 9:
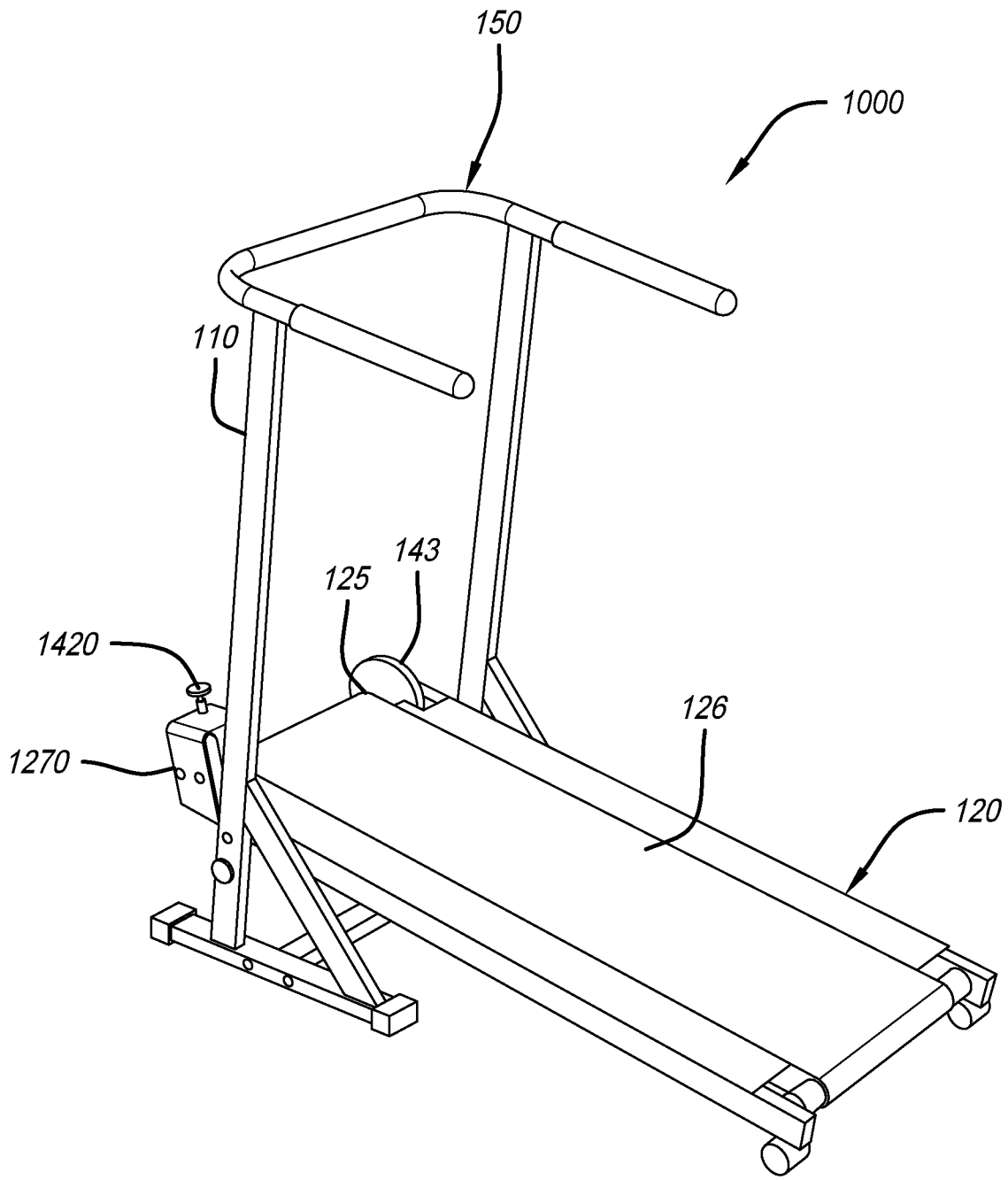
FIG. 9 is a perspective view of a treadmill having a partial protective cover for mounting of a resistance mechanism.

However, in a treadmill that is manually operated against braked resistance, particularly for use in a backward direction, risks associated with inadvertent belt contact may be greatly reduced. In such embodiments, it may be preferable to minimize the intrusion of protective covers and maximize the space efficiency of the treadmill. FIG. 9 illustrates another embodiment, in which treadmill 1000 has a partial cover 1270 covering braked right flywheel 140 (not shown). Partial cover 1270 may be formed from a partial metal box and secured to e.g., platform 120 and/or right upright 110. Adjustment dial 1420 is threaded through partial cover 1270 to apply varying pressure between friction brake 141 and flywheel 140. However, the width of partial cover 1270 is configured to envelope flywheel 140 and friction brake 141, with sufficient component clearance and minimal excess. All or nearly all of treadmill belt 126 may remain exposed around rear roller 125, maximizing the length of belt surface available for contact by a user during treadmill use. Therefore, the overall length of platform 120 may be minimized relative to the treadmill track length, promoting space efficiency of the device and reducing floor space required during use.

As illustrated in FIG. 9, the left side balancing flywheel 143 remains exposed. However, it is contemplated and understood that in other embodiments, another partial protective cover analogous to partial cover 1270, with or without the braking mechanism, may be utilized to cover flywheel 143.

In some embodiments, support handle 150 may be adjustable in height to accommodate differently-sized users and/or different modes of use. For example, support handle 150 may be mounted to right upright 110 and left upright 111 via telescoping beams or other mechanisms known in the art for adjusting the length of a bar or beam such as right upright 110 and left upright 111. In some modes of use, it may be preferable to adjust the height of support handle 150 over flat deck 123 such that cross portion 153 is roughly equal to the height of a user's hips.

Figure 11:
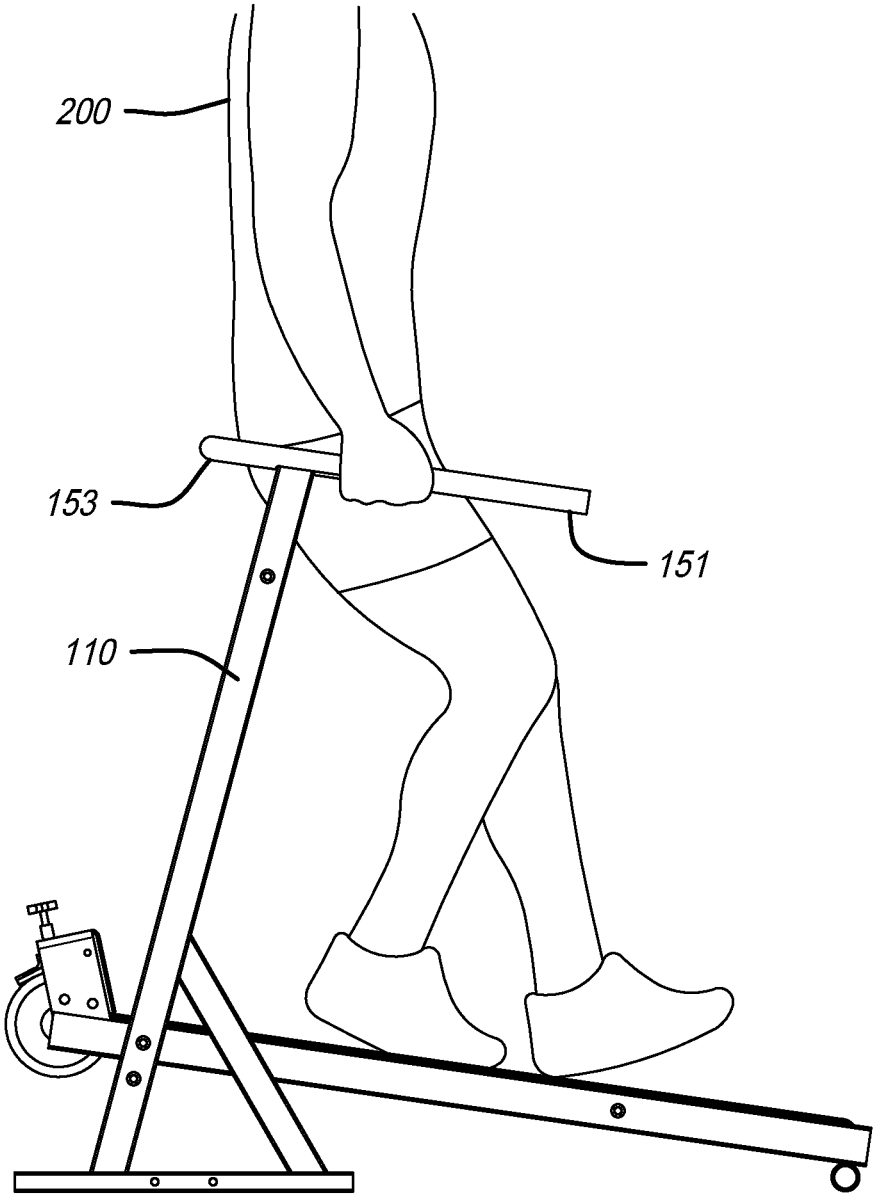
FIG. 11 is a side view of the treadmill for backward walking, in accordance with a first mode of use.

The arrangement of treadmill 100 provides options for numerous modes of use while backward walking, allowing users to work joints and muscles in the legs from varying angles. For example, a user 200 may stand relatively upright as shown in FIG. 11, holding right portion 151 and left portion 152 while leaning back against cross portion 153 for additional leverage to force movement of treadmill belt 126 against resistance provided by friction brake 141. Preferably, cross portion 153 will be perpendicular to a longitudinal direction of travel of treadmill belt 126, thereby facilitating use of cross portion 153 for leverage in pressing against treadmill belt 126 using the feet of user 200. By aligning the height of cross portion 153 with the hips of user 200, right portion 151 and left portion 152 may be readily grasped by the user's hands, while contact between a rear portion of the user's hips and cross portion 153 provides an anchor point to help isolate movement of the user's legs during use while the user pushes the treadmill belt away from the user using the user's feet.

Figure 12:
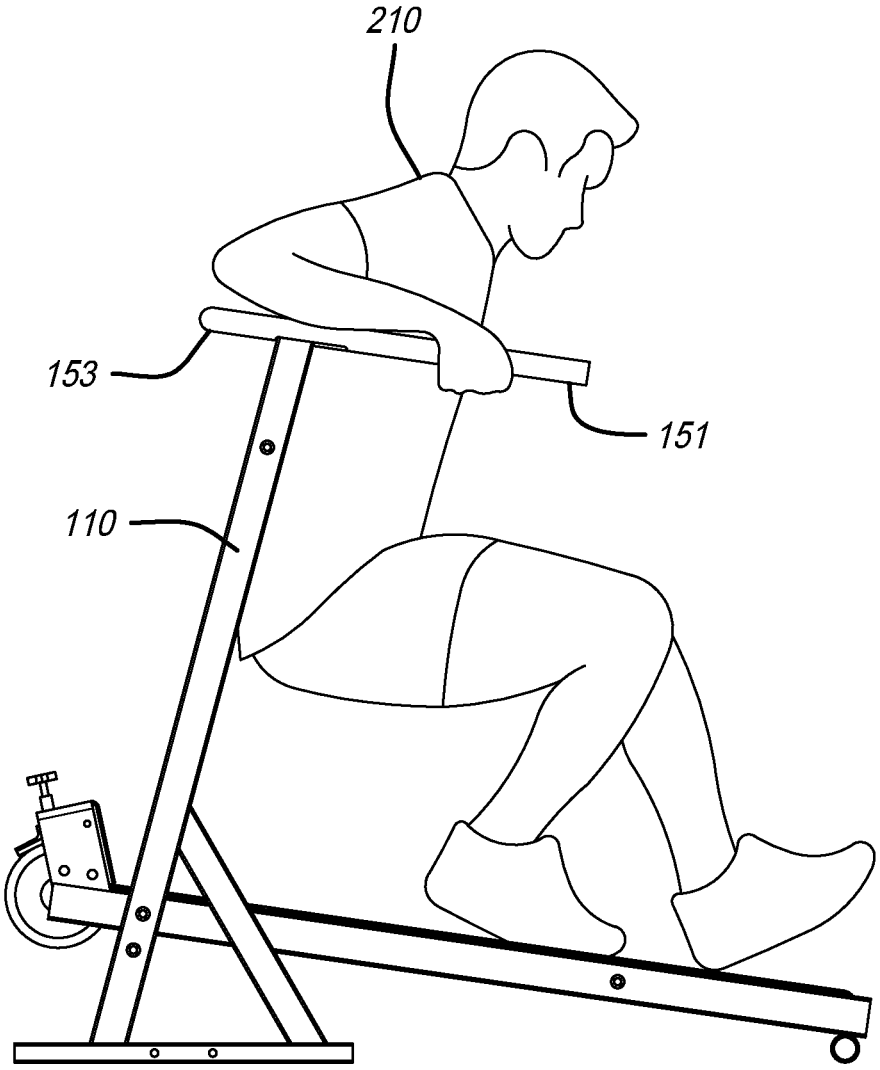
FIG. 12 is a side view of the treadmill for backward walking, in accordance with a second mode of use.

Alternatively, a user 210 may bend more deeply at the knees and hips, as illustrated in FIG. 12. The mode of usage illustrated in FIG. 12 works the knees and leg muscles of user 210 over a wider range of motion and/or with a deeper angle of knee bend. The forearms of user 210 may rest against right portion 151 and left portion 152 for support, while cross portion 153 extends across the user's mid-back for stability. In the mode of usage of FIG. 8, user 210 relies on core muscles to stabilize the hips. The range of motion over which a user's knees or other joints move may be varied by, amongst other things, adjusting the position of the user's upper body above the deck relative to the support handle, and/or adjusting the height of the support handle itself relative to the treadmill deck. These and other modes of use may be readily implemented using the arrangement of treadmill 100.

Figure 4:
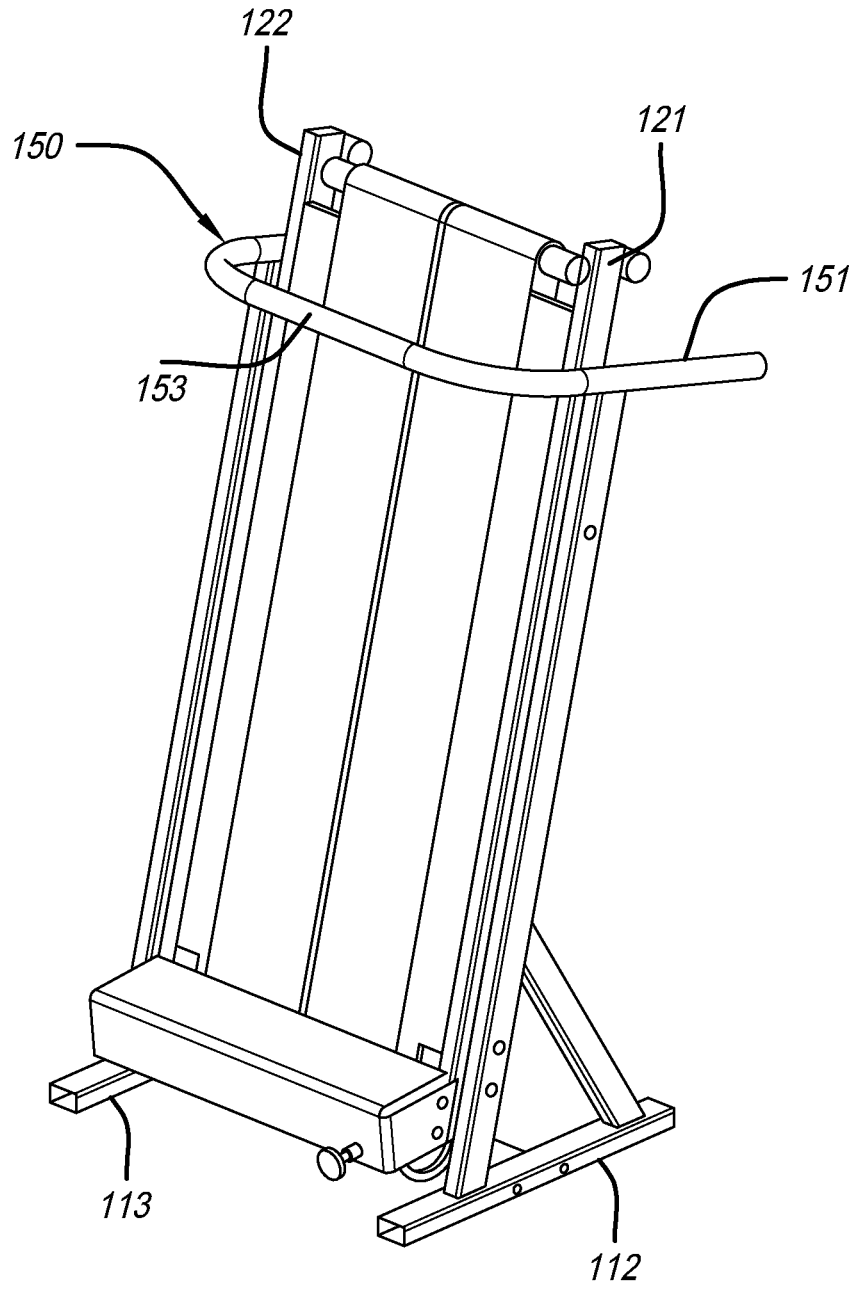
FIG. 4 is a front perspective view of the treadmill for backward walking, in a folded configuration for storage.
Figure 5:
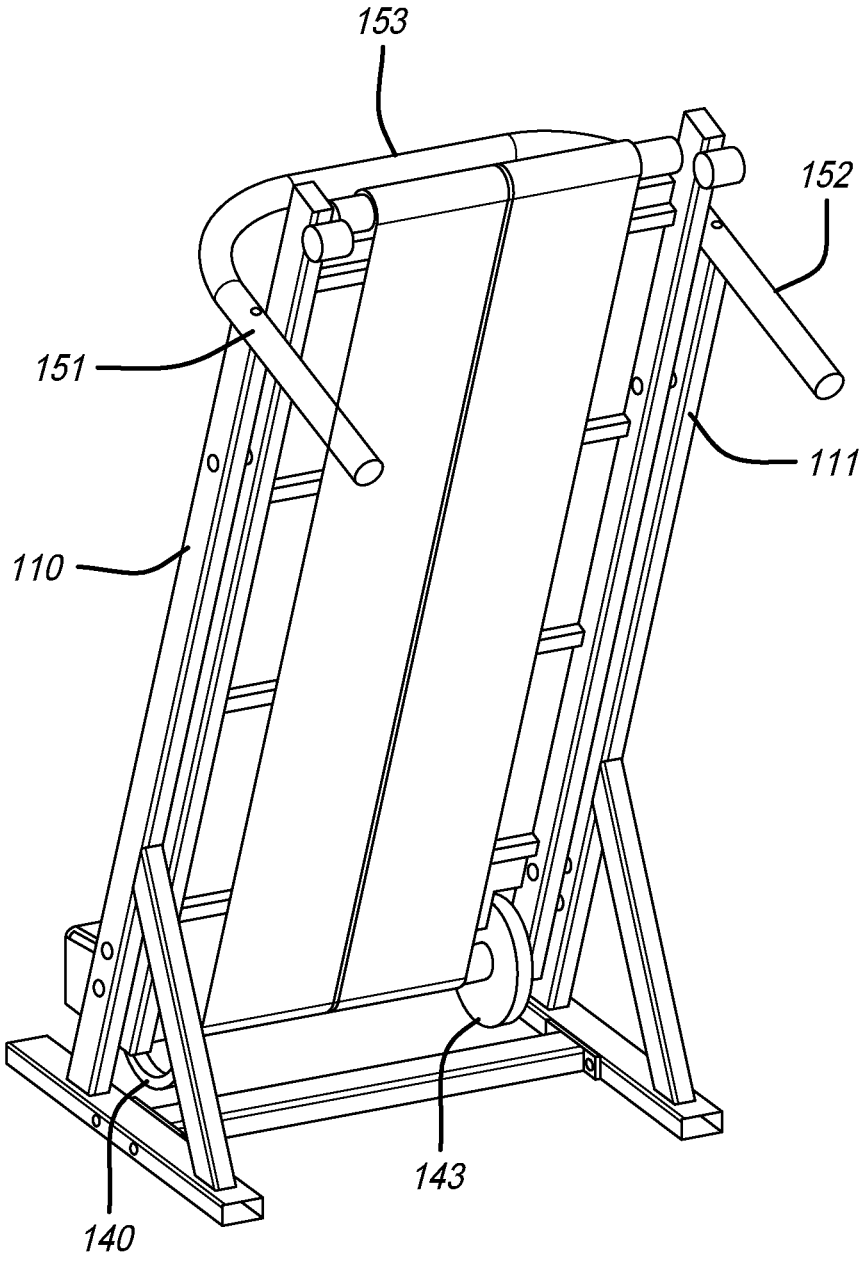
FIG. 5 is a rear perspective view of the treadmill for backward walking, in the folded configuration.

When not in use, treadmill 100 can be readily folded into an alternative configuration for storage with reduced space. FIGS. 4 and 5 illustrate such a stowed, storage configuration. In particular, a front edge of platform 120 may be tipped upward via, e.g., grasping and lifting front feet 128 or front roller 124, in order to transition treadmill 100 from the deployed configuration of FIGS. 1-3 to the stowed configuration of FIGS. 4-5. During transition, platform 120 moves around pivot 130 and pivot 131, pivoting up into the open side of support handle 150, until platform 120 comes to rest in a position coplanar with right upright 110 and left upright 111. The illustrated embodiment provides a relatively lightweight construction for platform 120, facilitating easy manual movement between the stowed and deployed configurations.

When in the upright stowed position, support handle 150 effectively wraps around an upper portion of platform 120, thereby minimizing risk of inadvertent contact with platform 120 and uncontrolled dropping of platform 120 back into a flat configuration for usage. Meanwhile, protective cover 127 faces outward, protecting rear roller 125 and flywheel 140 from inadvertent contact. A center of gravity for treadmill 100 is maintained well within the span of right base portion 112, left base portion 113 and support member 115 for stability. When desired, platform 120 may be lowered back down again into a deployed position for use.

While certain embodiments may be foldable, it is contemplated and understood that in other embodiments, the static frame (e.g., right upright 110 and left upright 111) and platform 120 may be in a static or fixed relationship. For example, in some embodiments, pivot 130 and pivot 131 may be replaced by fixed mounts. In other embodiments, pivot 130 and pivot 131 may be replaced by slidable mounts wherein platform 120 is vertically adjustable within a limited range of movement along right upright 110 and left upright 111. In yet other embodiments, pivot 130 and pivot 131 may be replaced by removable mounts, such that platform 120 can be readily detached from right upright 110 and left upright 111, for separate storage or other use.

It will be understood that various aspects or details of the disclosure may be changed without departing from the scope of the disclosure. It is not exhaustive and does not limit the claimed disclosures to the precise form disclosed. Furthermore, the foregoing description is for the purpose of illustration only, and not for the purpose of limitation. Modifications and variations are possible in light of the above description or may be acquired from practicing the disclosure. The claims and their equivalents define the scope of the disclosure. Moreover, although the techniques have been described in language specific to structural features and/or methodological acts, it is to be understood that the appended claims are not necessarily limited to the features or acts described. Rather, the features and acts are described as an example implementations of such techniques.

Conditional language such as, among others, "can," "could," "might" or "may," unless specifically stated otherwise, are understood within the context to present that certain examples include, while other examples do not include, certain features, elements and/or steps. Thus, such conditional language is not generally intended to imply that certain features, elements and/or steps are in any way required for one or more examples or that one or more examples necessarily include logic for deciding, with or without user input or prompting, whether certain features, elements and/or steps are included or are to be performed in any particular example. Conjunctive language such as the phrase "at least one of X, Y or Z," unless specifically stated otherwise, is to be understood to present that an item, term, etc. may be either X, Y, or Z, or a combination thereof.

Furthermore, the description of the different examples of implementations has been presented for purposes of illustration and description, and is not intended to be exhaustive or limited to the examples in the form disclosed. Many modifications and variations will be apparent to those of ordinary skill in the art. Further, different examples of implementations may provide different features as compared to other desirable examples. The example, or examples, selected are chosen and described in order to best explain the principles of the examples, the practical application, and to enable others of ordinary skill in the art to understand the disclosure for various examples with various modifications as are suited to the particular use contemplated.

It will also be understood that various aspects or details of the invention may be changed without departing from the scope of the invention. It is not exhaustive and does not limit the claimed inventions to the precise form disclosed. Furthermore, the foregoing description is for the purpose of illustration only, and not for the purpose of limitation. Modifications and variations are possible in light of the above description or may be acquired from practicing the invention. The claims and their equivalents define the scope of the invention.

The description of the different examples of implementations has been presented for purposes of illustration and description, and is not intended to be exhaustive or limited to the examples in the form disclosed. Many modifications and variations will be apparent to those of ordinary skill in the art. Further, different examples of implementations may provide different features as compared to other desirable examples. The example, or examples, selected are chosen and described in order to best explain the principles of the examples, the practical application, and to enable others of ordinary skill in the art to understand the disclosure for various examples with various modifications as are suited to the particular use contemplated.

What is claimed is:

1. A foldable treadmill for backward walking configured to rest on a ground surface, comprising:

a static frame comprising: a pair of upright bars laterally spaced from one another, and a support handle supported by the pair of upright bars; and a platform comprising:

a frame having a first end, a second end longitudinally spaced from the first end, and laterally spaced first side and second side;

a deck supported by the frame;

a first end roller and a second end roller, each rotatably mounted to the frame;

a treadmill belt encircling the deck, the first end roller and the second end roller; and a brake acting on at least one of the first end roller and the second end roller, to resist movement of the treadmill belt over the deck;

wherein each of the upright bars is attached to the frame by a pivot, the pivot being at a position along the first and second sides that is toward the first end of the frame, and at a position along the upright bars that is elevated from a ground surface upon which the pair of upright bars is supported;

wherein the support handle is a bar comprising a first side portion and a second side portion extending parallel to the first side and second side of the frame, and a cross portion interconnecting the first side portion and second side portion, the cross portion aligned longitudinally with a rear end of the treadmill belt;

wherein the first side portion, the second side portion and the cross portion define an area within which a user's body is positioned upright for backward walking during use; and wherein the platform may be pivoted between a deployed position, in which the deck is angled relative to the ground surface by an angle less than 30 degrees, and a stowed position, in which the platform extends upright between the support handle first side portion and second side portion.

2. The foldable treadmill for backward walking of claim 1, in which the support handle forms a C shape having an open side towards the second end of the frame; and wherein the platform pivots up into the open side of the support handle when moved into the stowed position, and down out of the open side of the support handle when moved into the deployed position.

3. The foldable treadmill for backward walking of claim 1, further comprising one or more flywheels, each of said flywheels secured to one of the first end roller and the second end roller.

4. The foldable treadmill for backward walking of claim 1, in which the brake is configured to apply frictional force resisting movement of the treadmill belt to one or more of the first end roller and the second end roller.

5. The foldable treadmill for backward walking of claim 1, further comprising a flywheel secured to the first end roller; and wherein said brake comprises a friction brake applying variable force to said flywheel to resist movement of the first end roller and the treadmill belt.

6. The foldable treadmill for backward walking of claim 1, wherein the upright bars are configured for variable length.

7. The foldable treadmill for backward walking of claim 6, wherein the upright bars comprise telescoping beams.

8. The foldable treadmill for backward walking of claim 1, where the first side portion and second side portion of the support handle occupy a plane that is angled relative to a plane of the deck.

9. The foldable treadmill for backward walking of claim 1, wherein the cross portion comprises a pad.

10. The foldable treadmill for backward walking of claim 9, wherein the pad is cylindrical with a hollow center through which the cross portion extends.

11. The foldable treadmill for backward walking of claim 1, further comprises a support strap extending between the first side portion and the second side portion of the support handle, whereby a user may lean back against or sit upon the support strap during use of the foldable treadmill for backward walking.

12. The foldable treadmill for backward walking of claim 11, wherein the support strap is elastic.

13. The foldable treadmill for backward walking of claim 1, wherein in the deployed position, the deck angles downward from the first end of the frame towards the second end of the frame, by an angle relative to level that is less than 10 degrees.

14. The foldable treadmill for backward walking of claim 1, wherein in the deployed position, the deck angles downward from the first end of the frame towards the second end of the frame, by an angle relative to a ground surface in the range of 7-9 degrees.

15. A method for a person to engage in backward walking on a treadmill for physical training, wherein the treadmill comprises a friction brake resisting movement of a treadmill belt over a deck, comprising:

grasping a left portion and a right portion of a support handle by a person's left hand and right hand, respectively, while standing on the treadmill belt;

leaning back against a cross portion of a support handle, the cross portion extending perpendicular to a direction of travel of the treadmill belt and being positioned behind the person at a height of the person's hips above the deck; and pressing forward against the treadmill belt using the person's feet, while using the cross portion of the support handle against the user's hips as an anchor point, to move the treadmill belt away from the person against resistance from the friction brake.

16. A method for a person to engage in backward walking on a treadmill for physical training, wherein the treadmill comprises a friction brake resisting movement of a treadmill belt over a deck, comprising:

resting a left forearm and a right forearm of the person along a left portions and a right portion, respectively, of a support handle, while resting the person's back against a support handle cross portion spanning the left portion and right portion of the support handle; and pressing forward against the treadmill belt using the person's feet, while using the support handle cross portion against the person's back as an anchor point, to move the treadmill belt away from the person against resistance from the friction brake.

17. The method of claim 16, further comprising adjusting a vertical position of the person's upper body relative to the support handle in order to vary a range of motion over which the person's knees move while pressing forward against the treadmill belt.

18. The method of claim 16, further comprising adjusting a height of the support handle relative to the deck in order to vary a range of motion over which the person's knees move while pressing forward against the treadmill belt.

* * * * *